US005307045A

United States Patent [19]

Senda et al.

[11] Patent Number: 5,307,045

[45] Date of Patent: Apr. 26, 1994

[54] HIGH-FREQUENCY INDUCTOR AND MANUFACTURING METHOD THEREOF

[75] Inventors: Atsuo Senda; Osamu Kanoh; Yutaka Sasaki, all of Kyoto, Japan

[73] Assignee: Murata Manufacturing Co., ltd., Kyoto, Japan

[21] Appl. No.: 634,724

[22] Filed: Dec. 27, 1990

[30] Foreign Application Priority Data

Dec. 28, 1989 [JP] Japan ..... 1-340730

[51] Int. Cl.[5] ..... H01F 27/30

[52] U.S. Cl. ..... 336/200; 29/602.1; 336/232

[58] Field of Search ..... 29/602.1; 336/232, 200, 336/223; 174/255, 256, 257

[56] References Cited

U.S. PATENT DOCUMENTS 4,226,932 10/1980 Ferraris ..... 174/256

FOREIGN PATENT DOCUMENTS 2-123706 5/1990 Japan ..... 336/200

2-126610 5/1990 Japan ..... 336/200

*Primary Examiner*—Thomas J. Kozma

*Attorney, Agent, or Firm*—Wegner, Cantor, Mueller & Player

[57] ABSTRACT

A high-frequency inductor comprising an insulating substrate; and a conductive land formed on the insulating substrate, the conductive land comprising at least two thin films formed of different compositions of metals, each of the metals is to be etched by such an etching agent that substantially never removes the other metals, the thin films being accumulated vertically.

5 Claims, 4 Drawing Sheets

HIGH-FREQUENCY INDUCTOR AND MANUFACTURING METHOD THEREOF

BACKGROUND OF THE INVENTION (1) Field of the Invention

This invention relates to a high-frequency inductor comprising a conductive land formed on an insulating substrate, especially an inductor realizing a high value of the Q factor, and to a manufacturing method of such an inductor.

(2) Description of the Prior Art

FIG. 1 shows a conventional high-frequency inductor used for a microwave circuit or the like; and FIG. 2 is a cross sectional view thereof.

A high-frequency inductor 20 comprises an insulating substrate 21, a spiral conductive land 22 formed on a surface of the substrate 21, and terminal electrodes 23*a* and 23*b* along opposed side ends of the substrate 21. An outer end 22*a* of the spiral conductive land 22 is connected with the terminal electrode 23*a*, and an inner end 22*b* is connected with the terminal electrode 23*b*. The conductive land 22 and the terminal electrodes 23*a* and 23*b* are covered with an insulating film 24, which has a connecting electrode 25 formed thereon. An end of the connecting electrode 25 is connected to the inner end 22*b* through a through-hole electrode 26, and the other end of the connecting electrode 25 is connected to the terminal electrode 23*b*, whereby the inner end 22*b* and the terminal electrode 23*b* are connected to each other.

The inductor 20 having the above construction is manufactured in the following way. The insulating substrate 21 is coated with a metal film by sputtering, evaporation or the like. Then, the metal film is photo-etched, whereby the spiral conductive land 22 and the terminal electrodes 23*a* and 23*b* are formed. The terminal electrode 23*a* and the outer end 22*a* are connected to each other. The insulating substrate 21 having the spiral conductive land 22 and the terminal electrodes 23*a* and 23*b* is coated with polyimide to form the insulating film 24. A portion of the film 24 corresponding to the inner end 22*b* is hollowed to make a through hole; and portions of the film 24 corresponding to the terminal electrodes 23*a* and 23*b* are removed. The insulating film 24 is coated with a metal film, which is then photo-etched to form the connecting electrode 25 and the through-hole electrode 26.

The above conventional inductor has a problem of having a low value of the Q factor due to a large resistance value. This occurs because the conductive land and the terminal electrodes are manufactured by the thin film technologies such as sputtering and evaporation.

This problem can be solved by increasing the thickness of the conductive land and the terminal electrodes. However, a thicker metal film takes longer to etch. If the etching lasts a long time, the metal film is etched not only vertically but horizontally. As a result, even a portion 30 (FIG. 3) which should be left to be the conductive land or the terminal electrode is etched, despite being the portion 30 covered with a mask 28. Consequently, the value of the Q factor is decreased, or the formation of the spiral conductive land cannot be realized.

SUMMARY OF THE INVENTION

Accordingly, this invention has a primary object of offering a high-frequency inductor having a large thickness with no possibility of under-etching and also realizing a high value of the Q factor.

Another object of this invention is to offer a method of manufacturing the above high-frequency inductor.

The above objects are fulfilled by a high-frequency inductor comprising an insulating substrate; and a conductive land formed on the insulating substrate, the conductive land comprising at least two thin films formed of different compositions of metals, each of the metals being capable of being etched by such an etching agent that substantially never removes the other metals, the thin films being accumulated vertically.

The metals may be selected from a group consisting of Ti, Ag, Cu, Al, Ni, Cr and Pd.

Three of the thin films respectively formed of Ti, Ti-Ag and Ag may be provided.

The conductive land may comprise two terminal electrodes formed on two different parts of the substrate and an inductor portion formed on a center of the substrate.

The inductor portion may be spiral, with an outer end of the inductor portion being connected to one of the terminal electrodes and an inner end of the inductor portion being connected to the other terminal electrode through a connecting electrode formed on an insulating member which is accumulated on a portion of the conductive land, the portion of the land being between the above other terminal electrode and the above inner end.

The conductive land may have another conductive land accumulated thereon except for the above portion thereof which is covered with the insulating member.

The above another conductive land may comprise at least two thin films formed of different compositions of metals, each of the metals being capable of being etched by such an etching agent that substantially never removes the other metals, the thin films being accumulated vertically.

The connecting electrode and the above another conductive land may have the same construction with each other.

The above objects are also fulfilled by a method of manufacturing a high-frequency inductor, the method comprising a first step of forming and accumulating vertically at least two thin films of different compositions of metals on an upper surface of an insulating substrate; and a second step of forming a conductive land by removing an unnecessary portion of the thin films accumulated in the first step one by one from top to bottom until the substrate is exposed, each of the thin films being etched with such an etching agent that substantially never removes the other metals than one of the metals included in the corresponding thin film.

The thin films may be each formed by a method selected from a group consisting of evaporation, sputtering and ion-plating.

The method may further comprise a third step of forming and accumulating vertically at least two thin films of different compositions of metals on an upper surface of an assembly of the substrate and the conductive land; and a fourth step of forming another conductive land by removing an unnecessary portion of the thin films accumulated in the third step one by one from top to bottom until the upper surface of the assembly is exposed, each of the thin films being etched with such an etching agent that substantially never removes the other metals than one of the metals included in the corresponding thin film.

The above objects are also fulfilled by a method of manufacturing a high-frequency inductor, the method comprising a first step of forming and accumulating vertically at least two thin films of different compositions of metals on an upper surface of an insulating substrate to make a first accumulated body; a second step of forming a first conductive land having a spiral portion and two terminal electrodes by removing an unnecessary portion of the first accumulated body film by film from top to bottom until the substrate is exposed, each of the thin films being etched with such an etching agent that substantially never removes the other metals than one of the metals included in the corresponding thin film; a third step of forming an insulating film on a portion of the first conductive land, the portion being between an inner end of the spiral portion and one of the terminal electrodes; a fourth step of forming and accumulating vertically at least two thin films of different compositions of metals on an upper surface of an assembly of the substrate, the first conductive land and the insulating film to make a second accumulated body; and a fifth step of forming a second conductive land by removing an unnecessary portion of the second accumulated body so that the second accumulated body except a portion thereof covering the insulating film is left in the shape of the first conductive land, and of simultaneously forming a connecting electrode by removing an unnecessary portion of the second accumulated body so that the second accumulated body covering the insulating film is left in the shape of the connecting electrode.

Ti may be etched by an aqueous solution of hydrofluoric nitric acid and Ag may be etched by an aqueous solution of ferric nitrate.

According to the above construction and method, the resistance value of the inductor is reduced while the thickness thereof is increased. Consequently, the value of the Q factor is increased.

Since each metal is etched by such an etching agent that has no influence on the other metals, under-etching can be prevented and the formation of the conductive land is facilitated.

BRIEF DESCRIPTION OF THE DRAWINGS

These and other objects, advantages and features of the invention will become apparent from the following description thereof taken in conjunction with the accompanying drawings which illustrate specific embodiments of the invention. In the drawings.

DESCRIPTION OF A PREFERRED EMBODIMENT

An embodiment according to this invention will be described referring to FIGS. 4 through 7.

Figure 1:
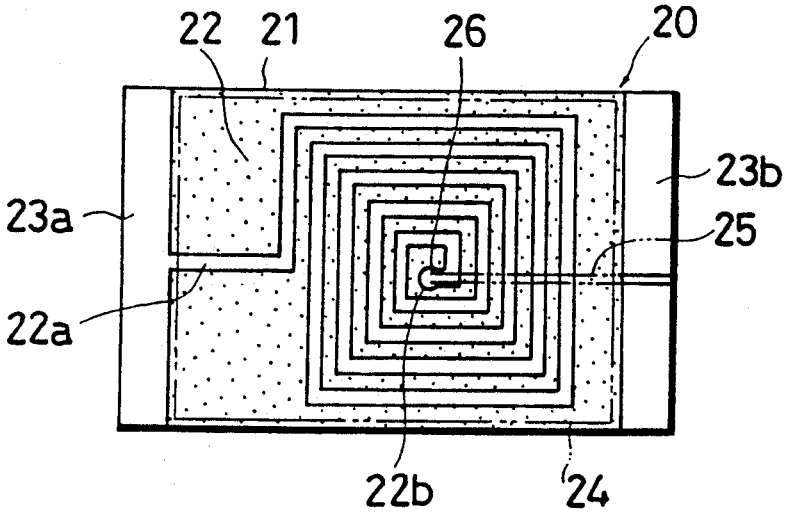
Fig. 1 Prior Art
FIG. 1 is a plan view of a conventional high-frequency inductor.
Figure 2:
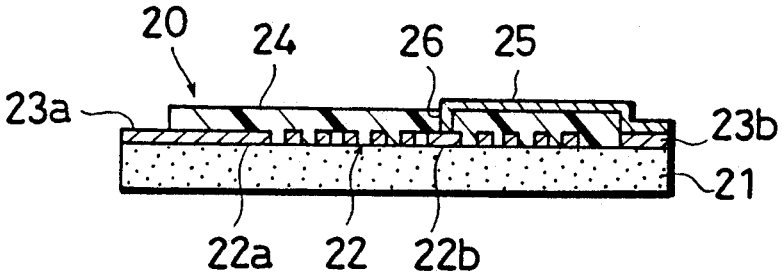
Fig. 2 Prior Art
FIG. 2 is a cross sectional view of the above inductor.
Figure 3:
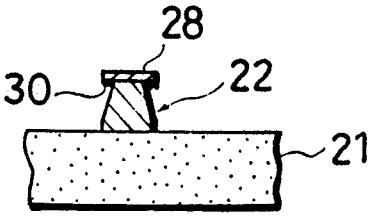
Fig. 3 Prior Art
FIG. 3 is an enlarged view of an essential portion of the above inductor.
Figure 4:
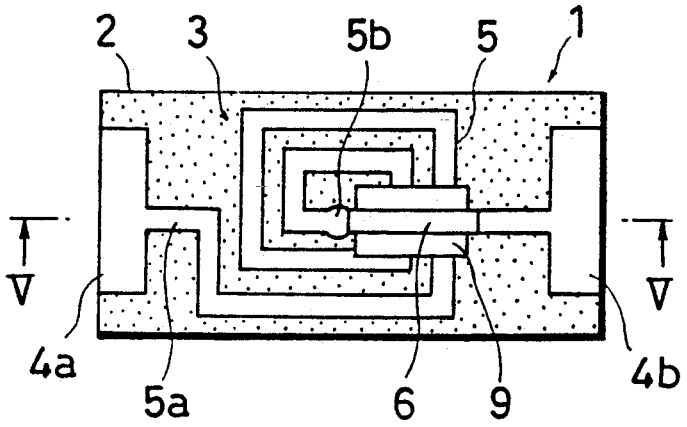
FIG. 4 is a plan view of a high-frequency inductor according to this invention.

As shown in FIG. 4, a high-frequency inductor 1 comprises an insulating substrate 2 and a conductive land 3 formed on the substrate 2. The conductive land 3 comprises terminal electrodes **4*a* and 4*b* formed along opposed side ends of the substrate 2 and also a spiral portion 5 formed on a center of the substrate 2. An outer end 5*a* of the spiral portion 5 is connected with the terminal electrode 4*a*. Between an inner end 5*b* of the spiral portion 5 and the terminal electrode 4*b*, the conductive land 3 is covered with an insulating film 9 formed of polyimide or polyamide. Formed on the insulating film 9 is a connecting electrode 6, the ends thereof being connected with the inner end 5*b* and with the terminal electrode 4*b***, respectively.

Figure 5:
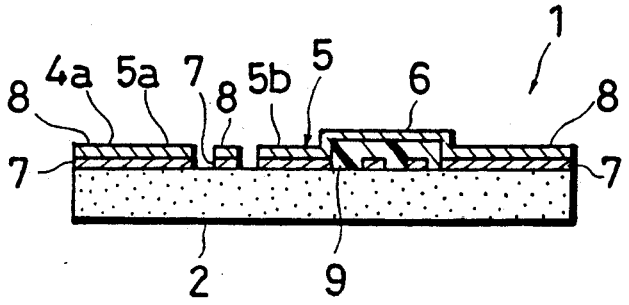
FIG. 5 is a cross sectional view of FIG. 4 taken along the line V—V.

As shown in FIG. 5, the conductive land 3 vertically comprises a first layer 7 formed on the substrate 2 and a second layer 8 formed on the first layer 7. Although not shown in FIG. 5, the first and second layers 7 and 8 each comprise three metal thin films accumulated vertically, the three films being formed of Ti, Ti-Ag and Ag from bottom to top. The first and the second layers 7 and 8 are each produced by forming the three metal thin films by the thin film technology such as evaporation, sputtering and ion-plating and then by etching each of the metal films by an etching agent which removes only the corresponding metal.

The high-frequency inductor 1 is manufactured as shown in FIGS. 6 and 7.

Step 1

Figure 6A:
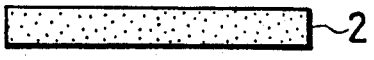
FIGS. 6*a* through 6*j* show first and second steps of manufacturing the high-frequency inductor of FIGS. 4 and 5.
Figure 6B:
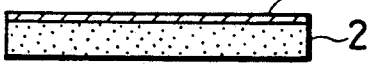
Figure 6C:
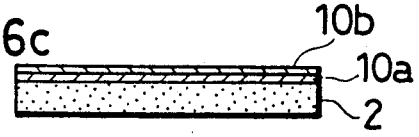
Figure 6D:
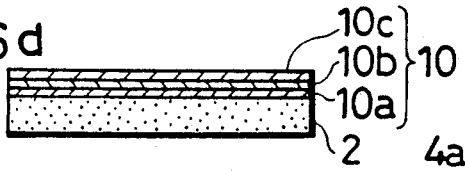

The insulating substrate 2 (FIG. 6*a*) formed of glass, crystallized glass, alumina or the like, is subjected to mirror abrasion, and a polyimide film (not shown) having a thickness of approx. 5 μm is formed on an upper surface of the substrate 2, whereby smoothing the upper surface. Then, a Ti film **10*a* having a thickness of approx 200Å is formed on an upper surface of the substrate 2** by sputtering (FIG. 6*b*). A Ti-Ag film **10*b* having a thickness of approx. 1,200Å is formed on an upper surface of the Ti film 10*a*** by sputtering Ti and Ag from two different sources simultaneously (FIG. 6*c*). An Ag film **10*c* having a thickness of approx. 3 μm is formed on an upper surface of the Ti-Ag film 10*b*** by sputtering (FIG. 6*d*). In this way, a three-layer conductive film 10 is completed. The Ti film **10*a* contributes to the better adherence between the conductive film 10 and the substrate 2**.

Step 2

Figure 6F:
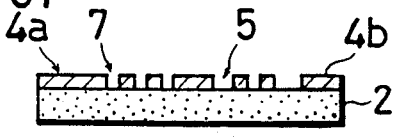

An upper surface of the conductive film 10 is masked in accordance with the shape of the conductive land 3. Then, the conductive film 10 is etched by such an etching agent that removes only Ag (for example, an aqueous solution of ferric nitrate), whereby non-masked portions of the films **10*c* and 10*b* are deprived of Ag. As a result, the film 10*c* is left in the shape of the conductive land 3** (7*c* of FIG. 6*e*). The conductive film 10 is further etched by such an etching agent that removes only Ti (for example, an aqueous solution of hydrofluoric nitric acid), whereby the non-masked portions of the films **10*b* and 10*a* are deprived of Ti. As a result, the films 10*b* and 10*a* are left in the shape of the conductive land 3** (7*b* and 7*c* of FIG. 6*e*). Then, the conductive film 10 is unmasked to complete the first layer 7 (FIGS. 6*f* and 6*g*).

Figure 6H:
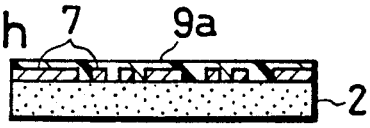
Figure 6I:
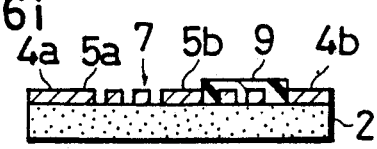
Figure 6E:
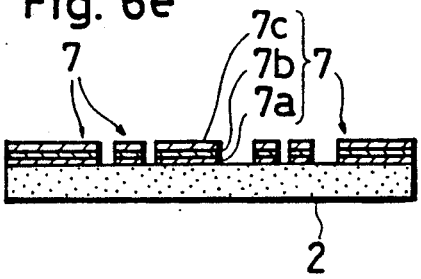
Figure 6G:
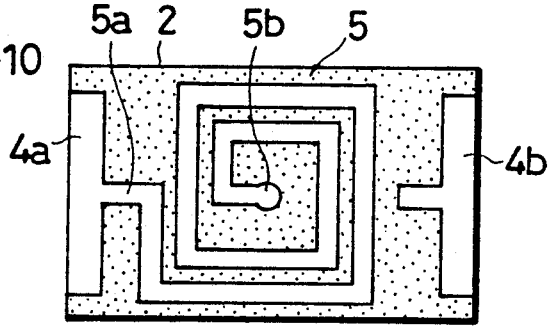
Figure 6J:
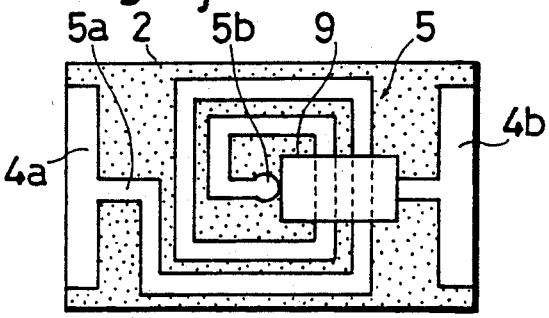

A surface of the first layer 7 is coated with a photoconductive polyimide resin to form an insulating film 9*a*, and the film 9*a* is dried (FIG. 6*h*). The insulating film 9*a* is exposed only between the inner end 5*b* and the terminal electrode 4*b* and the whole area of the insulating film 9*a* is developed, whereby the insulating film 9*a* is removed except for the exposed portion to form the insulating film 9 (FIGS. 6*i* and 6*j*). The insulating film 9 covers the corresponding portion of the conductive land 3.

Step 3

Figure 7A:
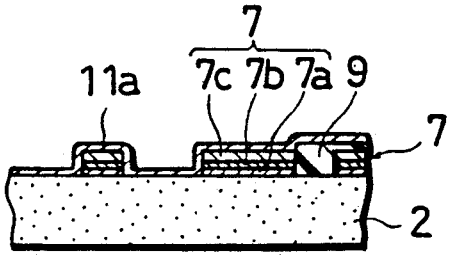
FIGS. 7*a* through 7*d* show third and fourth steps of manufacturing the high-frequency inductor of FIGS. 4 and 5.
Figure 7B:
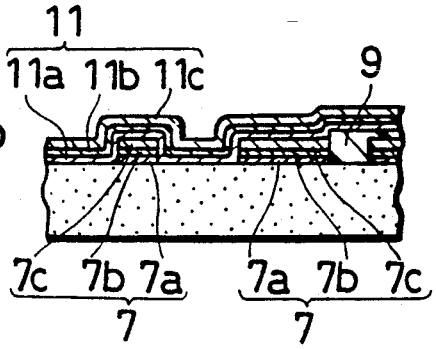
Figure 7C:
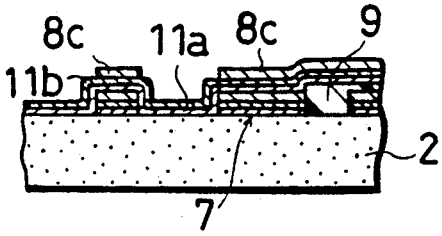

A Ti film 11*a* having a thickness of approx. 200Å is formed on the first layer 7 and the insulating film 9 by sputtering (FIG. 7*a*). A Ti-Ag film 11*b* having a thickness of approx. 1,200Å is formed on the film 11*a* in the same way as in Step 1, and an Ag film 11*c* having a thickness of approx. 3 μm is formed on the film 11*b* by sputtering. In this way, a three-layer conductive film 11 is completed (FIG. 7*b*). The conductive film 11 except a portion thereof covering the insulating film 9 is masked in accordance with the shape of the layer 7, and the conductive film 11 corresponding to the insulating film 9 is masked in accordance with the shape of the connecting electrode 6.

Step 4

Figure 7D:
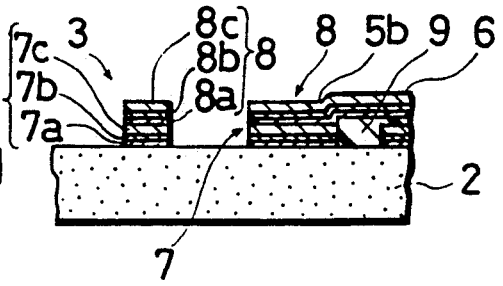

The conductive film 11 is etched by such an etching agent that removes only Ag, whereby non-masked portions of the films 11*c* and 11*b* are deprived of Ag. The film 11*c* is left in the shape of the first layer 7 and the connecting electrode 6 (8*c* of FIG. 7*c*). Since the Ag film 7*c* of the first layer 7 is covered with the Ti film 11*a*, the film 7*c* is not etched. The conductive film 11 is further etched by such an etching agent that removes only Ti, whereby the non-masked portions of the films 11*b* and 11*a* are deprived of Ti. The films 11*b* and 11*a* are also left in the shape of the first layer 7 and the connecting electrode 6 (8*b* and 8*a* of FIG. 7*c*). Since the Ti film 10*a* of the first layer 7 is covered with the Ag film 7*c*, the film 10*a* is not etched. The conductive film 11 is unmasked to complete the second layer 8 and the connecting electrode 6 (FIG. 7*d*). This means the completion of the conductive land 3 and also of the high-frequency inductor 1.

The two-layer construction of the high-frequency inductor 1 increases the total thickness of the inductor, which greatly contributes to the improvement of the Q factor. The inductor 1 attained the Q factor of as high as 30 at 400 MHz and L=18 nH and further attained Q=32 at L=69 nH. In terms of the resonance frequency, the inductor 1 realized 3.2 GHz when L=18 nH and 2.0 GHz when L=68 nH. The inductor may also be formed of only the first layer 1, in which case Q=30 was attained at 400 MHz and L=18 nH, and Q=14 was attained at L=69 nH.

According to the above manufacturing method, the Ti film 11*a*, the Ti-Ag film 11*b* and the Ag film 11*c* are formed in this order and then the assembly of the three films is etched first by an etching agent that removes only Ag and then by another etching agent that removes only Ti. The Ag film 10*c* of the first layer 7, which is covered with the Ti film 11*a*, is never etched by the etching agent that removes Ag. Also, the Ti film 10*a*, which is covered with the Ag film 10*c*, is never etched by the etching agent that removes Ti. Therefore, the conductive land 3 can be obtained in a desirable size and a desirable shape without fail.

For comparison, a Ti film having a thickness of 200Å was formed on the substrate 2 and an Ag film having a thickness of 6 μm (twice as thick as the Ag film of the embodiment of this invention) was formed on the above Ti film. When the assembly of the Ti film and the Ag film was masked and etched in the same way as in the embodiment, some masked portions were etched.

Although the conductive land 3 of the above embodiment comprises two layers 7 and 8, the land 3 can be formed of three or more layers by repeating the above steps.

Although the first and the second layers 7 and 8 each comprise three films of Ti, Ti-Ag and Ag in the above embodiment, the Ti-Ag film can be eliminated. Other metals such as Cu, Al, Ni, Cr and Pd can be used instead of the above three if only each metal is etched by an etching agent which removes only the corresponding metal.

This invention can also apply an inductor comprising a plurality of conductive land layers and a plurality of insulating layers accumulated alternately.

The conductive land can be of other shapes (for example, meander) than spiral.

Although the present invention has been fully described by way of an embodiment with references to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A high-frequency inductor, comprising:

an insulating substrate;

a first conductive land comprising first and second terminal electrodes formed on two different parts of the insulating substrate and a spiral inductor portion having an inner end and an outer end formed on a center portion of the insulating substrate, the outer end of the end of the inductor portion being connected to the first terminal electrode, the first conductive land comprising at least two thin films formed of different metal compositions, each of the metal compositions being capable of being etched by an etching agent that substantially does not remove the other metal compositions, the thin films being accumulated vertically;

an insulating member formed on a portion of said first conductive land which is located between the second terminal electrode and the inner end of the inductor portion, a second conductive land accumulated on the first conductive land except for the portion of the first conductive land covered with said insulating member, said second conductive land comprising at least two thin films formed of different metal compositions, each of the metal compositions being capable of being etched by an etching agent that substantially does not remove the other metal compositions, the thin films being accumulated vertically; and a connecting electrode between the second terminal and the inner end of the inductor portion, formed on the insulating member, the connecting electrode and the second conductive land having the same construction.

2. An inductor of claim 1, wherein the metal compositions are formed from metals selected from the group consisting of Ti, Ag, Cu, Al, Ni, Cr and Pd.

3. An inductor of claim 1, wherein the first conductive land includes three thin films respectively formed of Ti, Ti-Ag and Ag.

4. An inductor of claim 1, wherein the second conductive land and the connecting electrode each includes three thin films respectively formed of Ti, Ti-Ag and Ag.

5. An inductor of claim 3 wherein the second conductive land and the connecting electrode each includes three thin films respectively formed of Ti, Ti-Ag and Ag.

* * * * *